United States Patent [19]

Campbell et al.

[11] Patent Number: 5,002,503

[45] Date of Patent: Mar. 26, 1991

[54] COAXIAL CABLE CONNECTOR

[75] Inventors: George T. Campbell, Modesto; Shih-Chin Chu, San Ramon, both of Calif.

[73] Assignees: Viacom International, Inc., Cable Division, Pleasanton; Yumen, Inc., San Ramon, both of Calif.

[21] Appl. No.: 405,375

[22] Filed: Sep. 8, 1989

[51] Int. Cl.[5] ..... H01R 17/18

[52] U.S. Cl. ..... 439/578

[58] Field of Search ..... 439/578–585, 439/675, 98, 99, 607, 609, 610

[56] References Cited

U.S. PATENT DOCUMENTS

| | | | |
|---|---|---|---|
| 4,053,200 | 10/1977 | Pugner | 439/578 |
| 4,280,749 | 7/1981 | Hemmer | 439/578 |
| 4,575,274 | 3/1986 | Hayward | 439/584 |
| 4,583,811 | 4/1986 | McMills . | |
| 4,596,434 | 6/1986 | Saba et al. . | |
| 4,639,068 | 1/1987 | McMills et al. . | |
| 4,655,159 | 4/1987 | McMills . | |
| 4,668,043 | 5/1987 | Saba et al. | 439/585 |
| 4,674,818 | 6/1987 | McMills et al. . | |
| 4,755,152 | 7/1988 | Elliot et al. | 439/585 |
| 4,761,146 | 8/1988 | Sohoel | 439/584 |
| 4,799,902 | 1/1989 | Laudig et al. | 439/585 |
| 4,834,675 | 5/1989 | Samchisen . | |
| 4,834,676 | 5/1989 | Tackett . | |

*Primary Examiner*—David L. Pirlot

*Attorney, Agent, or Firm*—Skjerven, Morrill, MacPherson, Franklin & Friel

[57] ABSTRACT

A coaxial cable connector using the interference fit of a metallic sleeve forced into an open end of an annular space of a metallic coaxial cable connector end piece to provide the holding force required to maintain a tight mechanical connection between the coaxial cable and the coaxial cable connector thereby providing a good electrical contact between the coaxial cable shielding conductor and the coaxial cable connector, to provide good electromagnetic shielding performance for a central conductor from outside interference.

25 Claims, 14 Drawing Sheets

COAXIAL CABLE CONNECTOR

BACKGROUND OF THE INVENTION

1. Field of the Invention

This invention relates to a connector for a coaxial cable and in particular to a two-piece connector which upon assembly becomes a one-piece connector which provides a connection which is completely shielded and thus remains leakproof to electromagnetic radiation over time.

2. Description of the Prior Art

Coaxial cable (FIGS. 1*a* and 1*b* ) consists of a centrally located conductor (typically copper) 1 surrounded by a first dielectric insulator 2, which forms an annular ring of an approximately uniform thickness around the centrally located conductor 1. The outer surface of the dielectric insulator 2 is covered by an outer conductor (typically a uniformly circularly braided conducting wire such as aluminum) 4 which serves as a ground shield and which in turn is covered by a second dielectric layer 5 (sometimes called the outside or outer insulation layer). Originally, the outer (shielding) conductor was a single layer of uniformly circularly braided conducting wire 4. More recently a third layer of conductive material 3 (typically a relatively thin covering such as a foil of the same conductive material as the wire braid), shown in FIG. 1*b*, has been added under the wire braid outer conductor 4 but outside the first layer of dielectric insulation to provide additional shielding. Conductive material 3 can be bonded to first dielectric 2 or can be unbonded, and can be applied in various thicknesses which are known as single, double, and triple foil cable. Outer conductor 3, as noted above the layer of uniformly circularly braided conducting wire, covers this foil. Outer conductor 4 is typically a braid which is manufactured in various braid coverage percentages, i.e., 40%, 67%, and 90%. Second dielectric layer 5 surrounds the outer conductor 4 (FIGS. 1*a* and 1*b*).

Absent defects in the cable, the industry has accepted that coaxial cable alone provides a very good means for shielding electrical signals from their surrounding electromagnetic environment, particularly at signal frequencies above 5 MHz.

Coaxial cables are commonly used to transmit video signals. To ensure a clean, clear picture on a television set, it is important to avoid interference between the electrical signal carried through the coaxial cable and the surrounding electromagnetic environment.

Any loss of shielding when connecting one coaxial cable to another by means of a coaxial cable connector can cause interference between signals being conducted in and transmitted outside the cable. Connectors for coaxial cable have evolved over time and many different structures have been tried to connect coaxial cables while maintaining the integrity of both the insulation and the shielding of the coaxial cable and of the connector. Each prior art structure has some performance or cost drawback.

While coaxial cables are used in many industries, a particularly important use is in the telecommunications industry for transmitting television signals from a receiving antenna or cable television source to television sets. While coaxial cable is a good means for transporting the television signal, whenever there is a termination of the coaxial cable requiring a connector (such as connecting the coaxial cable to a main cable line, connecting the coaxial cable to a customer's point of service, or just to lengthen a previously installed cable) the cable television industry has found that the television signal carried on the central conductor in a coaxial cable will egress as well as receive outside signals when there is a gap between the shielding of the coaxial cable and the connector. This loss of shielding integrity allows external signals to be picked up by the central conductor in the coaxial cable and to interfere with the cable television signal and also allows the cable television signal to leak out of the coaxial cable.

In 1935 the F.C.C. assigned a frequency spectrum to be used for transmitting television signals. The frequency band from 50 MHz to 88 MHz contains channels 2 through 6 and the frequency band from 174 MHz to 216 MHz contains channels through 13 for a total of 12 VHF channels. State of the art cable systems have up to 88 channels and cover frequency spectrum from 5 MHz to 550 MHz. This is allowed only if the television signals remain inside the coaxial cable. If the signals are allowed to escape the coaxial environment, i.e. be retransmitted from faulty connectors, they can and do interfere with sensitive frequency bands such as those utilized by, for example, police and fire department radios, aircraft navigation systems, and marine and aircraft distress signals.

Because there is normally a timing delay between signals sent over cable television lines when compared to signals received directly from an antenna source, two out-of-phase signals, a strong signal and a weak signal, are received by the television tuner. The presence of two such signals causes what is commonly known in the industry as "ghosts."

A solution is needed to eliminate "ghosts" created as a result of interference between television signals sent via coaxial cable from a cable television source and television signals which are transmitted through the environment by television stations (and are available in most cities and towns merely by an antenna hookup).

Apart from a few exceptions, experience has shown that problems which cable customers experience having to do with interference or "ghosts" can be traced to connector failure. A connector is said to have "failed" when interference problems associated with signal leakage are eliminated by the replacement of that particular coaxial cable connector. While the connectors individually cost less than fifty cents per unit, the cost of sending a technician to locate and identify a customer problem or replace connectors due to normal maintenance or system expansion can amount to $30.00 or more per connector unit.

This problem has been identified in the cable television industry for a number of years. Research has recently been undertaken to compare the various connectors available on the market and their performance compared with each other over time. Preliminary results of this ongoing study indicate that each connector examined exhibits a maximum level of performance at the time of assembly and installation. This performance degrades measurably with time until at some point the performance is so low that the connector is deemed to have "failed."

Historically, the first connectors for coaxial cables (illustrated in FIG. 2*a* in an exploded view) were two piece connectors generally referred to in the industry as F-connectors. Connector 8, illustrated in FIG. 2*a*, is illustrative of a typical F-connector which is comprised of free-spinning nut 9 which is retained and integrated at one end of hollow post 10 by collar 11. Barb 12 is provided at the opposite end of post 10. The second piece of the two pieces is metal sleeve 13 which, when crimped in place around outside insulator 5 of a coaxial cable which has been pressed onto the hollow post 10, holds the connector on the end of the coaxial cable. The inside diameter of the opening in post 10 is slightly larger than the outside diameter of first dielectric 2. When post 10 is installed on a coaxial cable, the dimensions of barb 12 and thickness of post 10 in barrel portion 14 is such that barb 12 and barrel portion 14 are positioned between first dielectric 2 and outer conductor 4.

These pieces are assembled by the following steps illustrated in FIGS. *2b–2d*. As illustrated in FIG. *2b*, typically outer insulator 5 is stripped off for a distance of ½ an inch, then the exposed outer braid conductor 4 is folded back along the outer insulation (FIG. *2c*). Then the first dielectric 2 is stripped away for a distance of ⅜" exposing the center conductor 1 (FIG. *2d*). Metal crimp sleeve 13 is placed over the end of the coaxial cable. Then, the end of hollow post 10 having barb 12 is slipped over first dielectric 2 covered with the third layer of conductive material 3, typically aluminum foil, paying careful attention to leave the third layer of conductive material 3 intact and undamaged. Post 10 is forced down along first dielectric 2 until it is stopped by end 15 of collar 11 meeting the end of outer insulation layer 5 and braid outer conductor 4. Post 10 is forced down between the third layer of conductive material 3 covering the outside of first dielectric insulator 2 and outer conductor 4 which is inside of second dielectric layer 5. Metal sleeve 13 which was first put on the end of the cable is then slipped over the outside of end connector where post 10 with barb 12 has been stopped and is then crimped in place. Second dielectric layer 5 and outer conductor 4 are trapped between crimp sleeve 13 and post 10, which acts as a mandrel, and this prevents second dielectric layer 5 from becoming elliptical or misshaped.

Historically, this crimping has been done in many different ways. One way was to crimp sleeve 13 as mechanical wire connectors are crimped, at the center (i.e., with pliers or a standard wire crimping tool), relying on the work-hardening of the material of the crimped sleeve 13 to maintain the inward force on the outside insulation 5, forcing outer conductor 4 of the cable onto barb 12 of post 10 and relying on the strength of post 10 to not crush during the crimping process.

In a second crimping technique which has been used oversized sleeve 13 is crimped into two loops, one around the cable, the other smaller one off to one side consisting of the excess circumference of the sleeve 13 not needed to crimp the loop around the cable. This prevented damage to dielectric insulator 5 by direct crimping. Work-hardening of the sleeve material provided the crimping force. Proper or improper crimping in this manner would often cause the sleeve 13 to break at its point of greatest bending, releasing the tension thus causing the connection to fail.

In yet another method, metal sleeve 13 is crimped on post 10 and barb 12 using a hex-patterned crimp. The general idea of this method of attachment is to distribute the crimping force somewhat uniformly around outer insulation layer 5 maintaining a mechanically tight connection. A special hex-crimping tool is used to make this crimp. Unfortunately, this method did not solve the problem of uniform shielding as pressure was concentrated on the six flats of the hex while the six points had little or no pressure (FIG. *2e*).

While at the time of assembly this connection seemed to be quite tight and efficient, over time the metal of the sleeve 13 which had been crimped relaxed slightly and insulation 5 which had been captured by crimping flowed to a point of lower stress thereby making the connection loose.

A one-piece connector, of which connector 17 illustrated in exploded view in FIG. 3 is an example, has also been manufactured and used. It differs from two-piece connector 8 only in that the metal sleeve 18 which was crimped over the coaxial cable is also fixed to post 19, whereas in two-piece connector 8 metal crimp sleeve 13 is loose. Connector 17 is provided commercially with nut 20 installed on post 19 and metal sleeve 18 is pressed into place on post 19 to form the completed, assembled unit as illustrated in FIG. 4 in partial cut-away fashion. One problem with a connector such as connector 17, in addition to the problem with loosening after a period of time after assembly, was that during assembly of connector 17 on to a coaxial cable, the insertion of post 19 between conductive foil 3 covering first dielectric insulator 2 and the wire braid outer conductor 4 inside the outside insulation layer 5 could not be observed If during installation, as post 19 was being inserted into the cable the foil was wrinkled or torn a faulty connection could result.

A product developed by the Raychem Corporation to attempt to address the above-noted problems is generally called an EZ-F type connector. The EZ-F connector as manufactured by Raychem consists of four pieces in a single assembly, an example of which is illustrated in FIG. 5 (each piece illustrated in cross section) and the assembly indicated by reference character 23. The individual parts of connector 23 are post 24, compression ring 25, retaining nut 26, and outside piece 27. As illustrated in FIG. 6, outside piece 27 encloses the completed assembly The post 24 is positioned within outside piece 27 and receives the end of the stripped coaxial cable. Compression ring 25, composed of a plastic material, is placed between post 24 and retaining nut 26. As best illustrated in FIG. 6, retaining nut 26 holds the assembly together and prevents compression ring 25 and post 24 from coming out of outside piece 27. The F-connector type female threads 28 in the front of outside piece 27 are of such a diameter that post 24 cannot slip through that space. F-connector type female threads 28 in the front of outside piece 27 are ⅜"×32 TPI threads, the type normally used in coaxial connectors. As generally commercially sold, connector 23 is completely assembled, with retaining nut 26 holding compression ring 25 and post 24 within outside piece 27.

After the stripped coaxial cable (with wire braid outer conductor 4 folded back over outside insulation layer 5 for approximately one-eighth inch) is inserted into an assembled connector 23, a tool is utilized to lock connector 23 on to the end of the coaxial cable. This tool threads into connector 23 forcing compression ring 25 to plastically deform into the annular open space 29 of post 24 to clamp and hold outside insulation layer 5 of the coaxial cable, and the wire braid outer conductor 4 in annular space 29 of post 24. In contrast to a one piece connector such as connector 17 (illustrated in FIGS. 3 and 4), post 24 is nickel plated brass and performs very efficiently when studied in comparison with other connectors. FIG. 6 illustrates connector 23 which has been crimped onto the end of a coaxial cable For ease of understanding, a highly enlarged cross section taken along lines 7—7 is illustrated in FIG. 7. One of the problems which plagued that type of connector that still exists with the EZ-F type connector in that the insertion of the coaxial cable into the assembled connector 23 is blind, i.e., the assembler cannot see how post 24, which is being forced between foil 3 covering first dielectric insulator 2 and wire braid outer conductor 4 inside outside insulation layer 5 is progressing. Thus post 24 can wrinkle and tear foil 3 covering first dielectric insulator 2 without the assembler realizing it, thereby creating a faulty connection.

Another manufacturer, LRC Augat, has provided a coaxial cable connector which is generally referred to as a Snap-N-Seal connector. A connector of this type is illustrated in FIGS. 8 and 9, and indicated by reference character 30. A similarly constructed connector is also illustrated in U.S. Pat. No. 4,834,675, issued May 30, 1989. As will be best appreciated by reference to FIG. 9, connector 30 contains a free-wheeling nut 31 and a centrally located hollow post 32 and plastic sleeve 33, which locks in place in outer casing 34 upon final assembly Outer casing 34 is, however, much larger in diameter than any of the other parts of any of the connectors described above which contact wire braid outer conductor 4.

During assembly, the cable is inserted through plastic sleeve 33 with shoulder 35 of sleeve 33 away from the end (FIG. 9). Then connector 30 is pushed on to the cable. Plastic sleeve 33 is then pressed into outer casing 34, securing plastic sleeve 33 in outer casing 34 and also pressing the wire braid outer conductor 4 which is extending out of the end of the coaxial cable inside outer casing 34 against the casing body. Once plastic sleeve 33 has been inserted, it is held there elastically by locking depression 36 (FIG. 8) in outer casing 34 near the left hand side (as viewed in FIG. 8) of outer casing 34. Locking depression 36 matches with locking projection 37 (FIG. 8) on plastic sleeve 33 to cause sleeve 33 to be permanently locked in place in an elastically compressed state. The force used to introduce plastic sleeve 33 into outer casing 34 also provides a means for deforming the right most end (as viewed in FIGS. 8 and 9) of plastic sleeve 33 which contacts wire braid outer conductor 4 inside outer casing 34, thereby pressing wire braid outer conductor 4 against outer casing 34, forming an electrical connection, for the purposes of shielding the central conductor 1. As will be appreciated by reference to FIG. 9, the end of post 32 (which is inserted between braid 4 and foil 3) is interior of outer casing 34, creating a partially blind insertion situation since the leading edge of post 32 is not easily observed during installation of connector 30 on a coaxial cable.

SUMMARY OF THE INVENTION

This invention provides a low cost coaxial cable connector whose performance equals or exceeds the performance of other connectors existing today and whose cost is but a fraction of the cost of most prior art connectors.

In accordance with this invention, a two piece connector is provided which upon assembly becomes essentially a one piece connector which maintains the integrity of the electrical shield of the coaxial cable through the connector, provides an extended ground plane for the connection and additionally provides strong mechanical joint as the result of the formation of an extremely tight mechanical bond between the two pieces Generally, in accordance with this invention, the first piece and the second piece are made of the same material, preferably a metal, and the first piece has an inside diameter slightly less than the outside diameter of the second piece such that the first piece can be pressed over the second piece thereby to form an integral mechanical bond circumferentially around the outer surface of the second piece which both provides mechanical strength and electrical shielding.

More specifically, in accordance with the present invention, the first piece is an integral end piece comprised of a post, a collar, and a nut and the second piece comprises a sleeve. To assemble the two pieces, the sleeve is first slipped over the end of the cable, then the cable is prepared stripped with wire braid folded back) and the prepared end of the coaxial cable is inserted into the post and under the collar of the integral end piece and then the sleeve is pressed into the collar of the integral end piece with an interference fit, causing the coaxial cable to be held in the first piece of the connector. The pressed fit of the sleeve with the integral end piece presses the coaxial cable wire braid against the integral end piece to create an excellent electrical contact and a good electromagnetic shield for the central conductor. The uniform pressure around the perimeter of the outer insulator avoids the problem of "cold plastic flow" due to irregular distortions in prior art retaining sleeves.

An advantage of the connector of the present invention is that the person inserting the coaxial cable in the post of the end connector can observe and correct any potential damage to the foil covering the dielectric insulation before pressing the cable further into the connector and a uniform 360° pressure exerted on the outer insulator and braid insuring the best possible electrical contact. Accordingly, the connector of the present invention can be successfully installed on a coaxial cable by one having less skill than that required to install one of the prior art connectors on a coaxial cable.

A special tool suited to the pressing the first piece of the connector onto the sleeve ensures correct final assembly of the connector. Also the length of the outside insulation which is removed beyond the point where the central conductor is exposed is variable. In the preferred embodiment of the present invention the first and second pieces are constructed of tin coated brass.

This invention will be more fully understood in light of the following detailed description taken together with the drawings.

DESCRIPTION OF THE PREFERRED EMBODIMENT

Figure 1A:
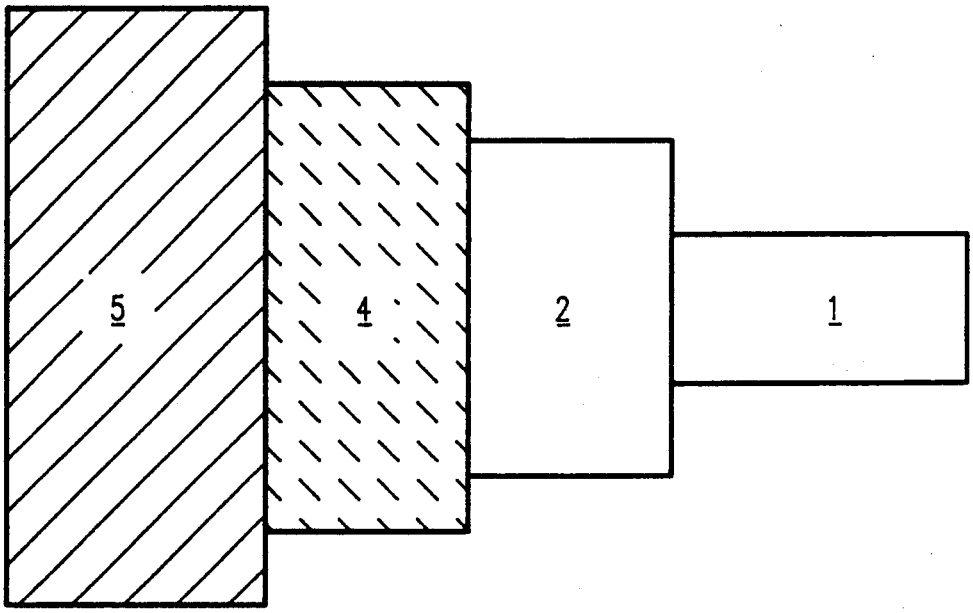
PRIOR ART FIG. 1a
FIGS. 1*a* and 1*b* illustrate the typical construction of a coaxial cable.
Figure 1B:
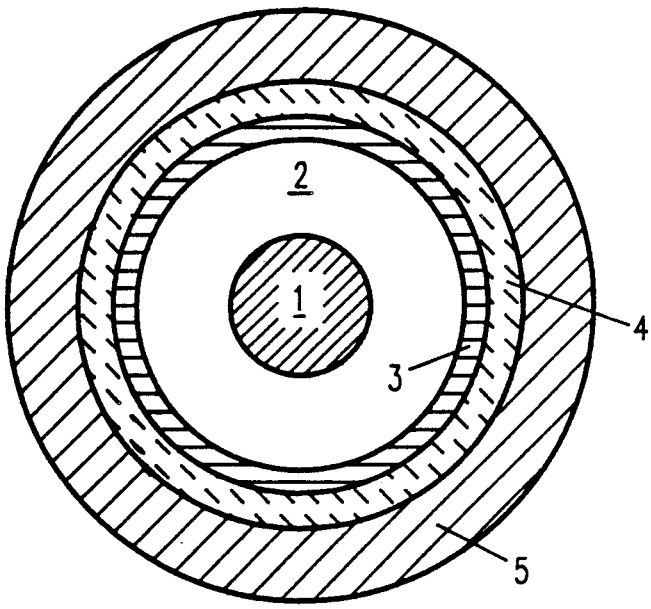
PRIOR ART FIG. 1b
Figure 2A:
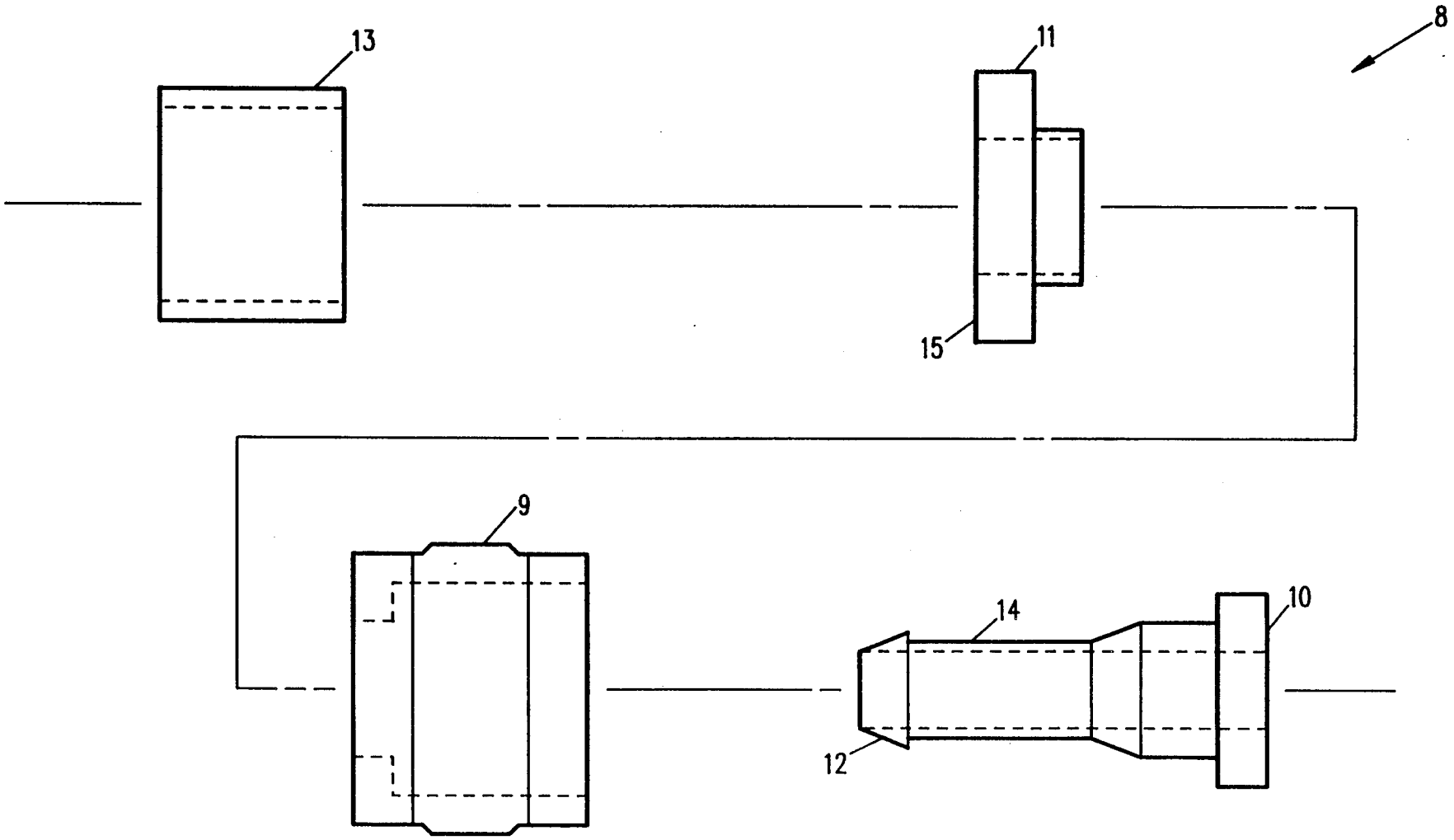
PRIOR ART FIG. 2a
FIG. 2*a* illustrates in an exploded view a two-piece, prior art F-type connector.
Figure 2B:
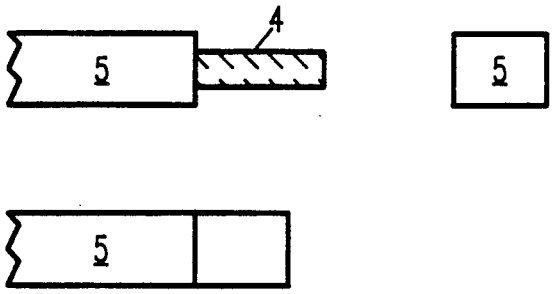
PRIOR ART FIG. 2b
FIGS. 2*b*–2*d* illustrate the typical preparation steps used on coaxial cable when preparing the cable for receiving an F-type connector.
Figure 2C:
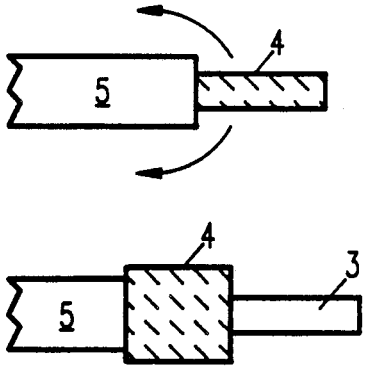
PRIOR ART FIG. 2c
Figure 2D:
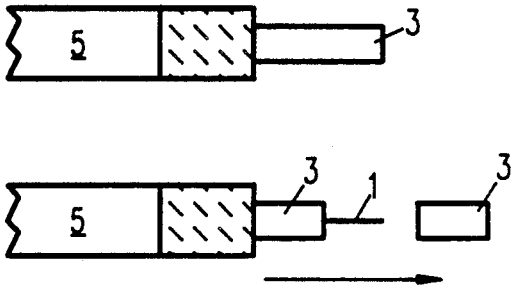
PRIOR ART FIG. 2d
Figure 3:
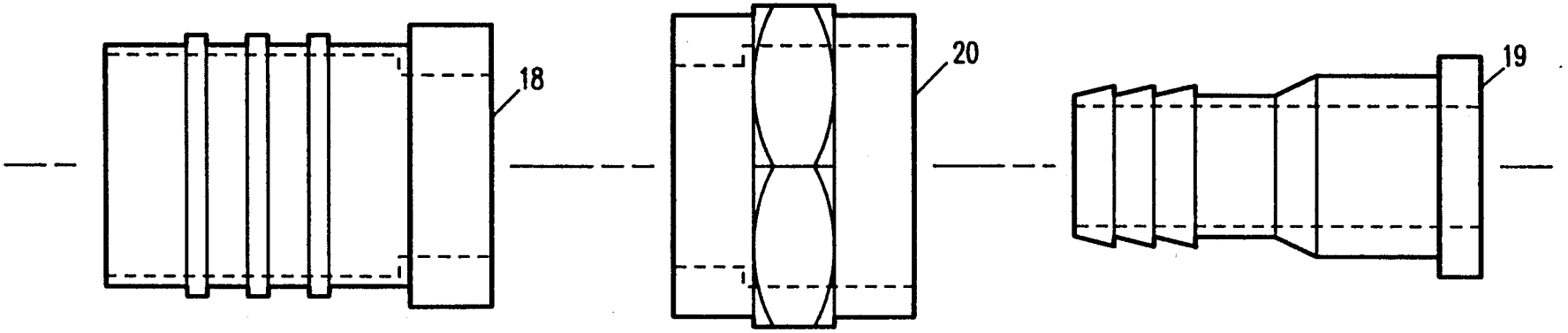
PRIOR ART FIG. 3
FIG. 3 illustrates the typical construction of a one-piece, F-Type, connector.
Figure 2E:
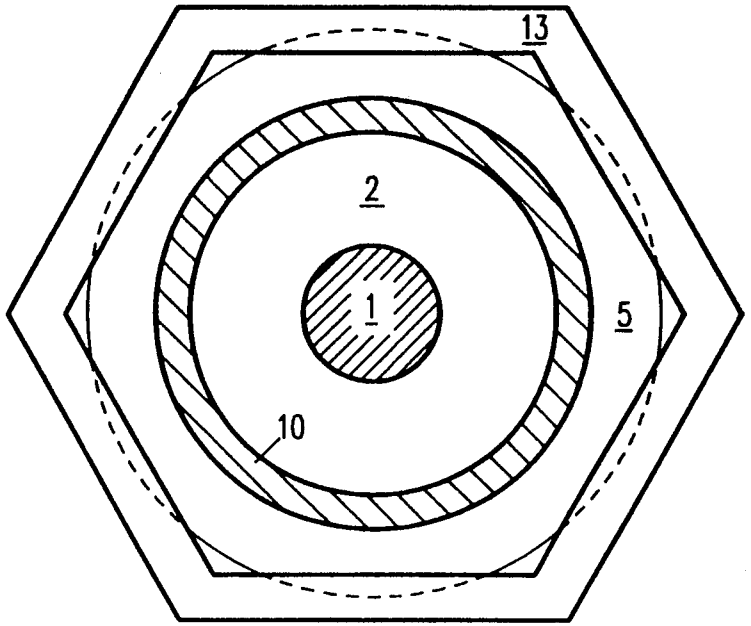
PRIOR ART FIG. 2e
FIG. 2*e* illustrates a cross sectional view of a hex crimped sleeve on an F-connector with cable included.
Figure 4:
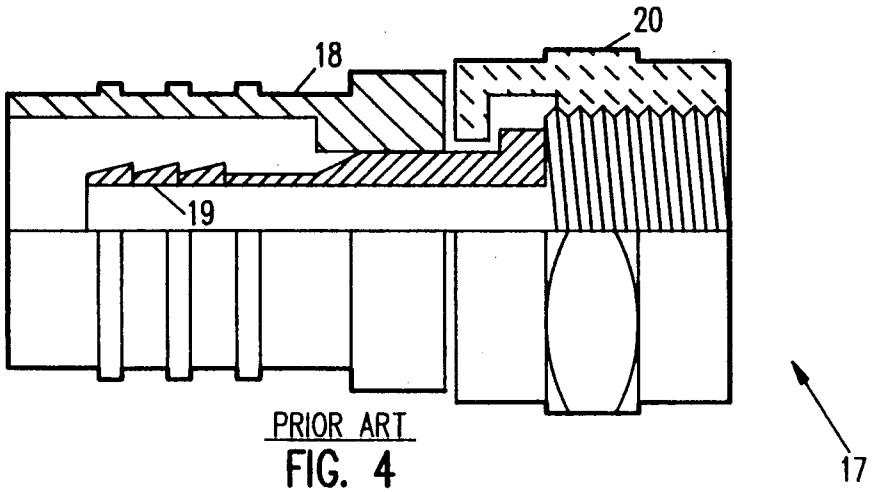
PRIOR ART FIG. 4
FIG. 4 is a partial sectional view of an assembled one-piece connector.
Figure 5:
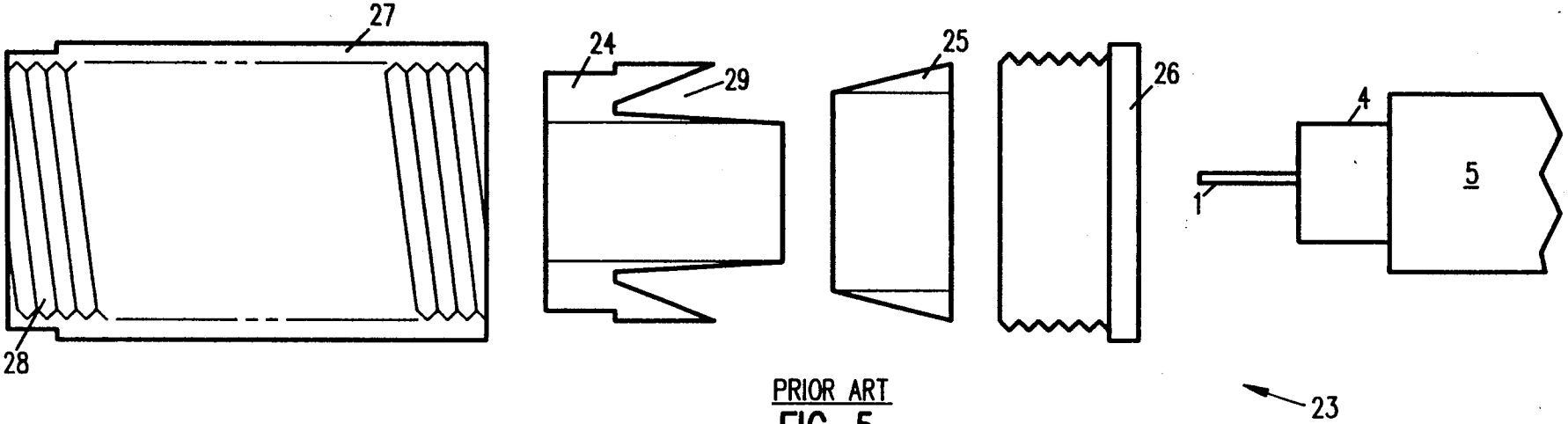
PRIOR ART FIG. 5
FIG. 5 is an exploded cross sectional view of a Raychem EZ-F type connector.
Figure 6:
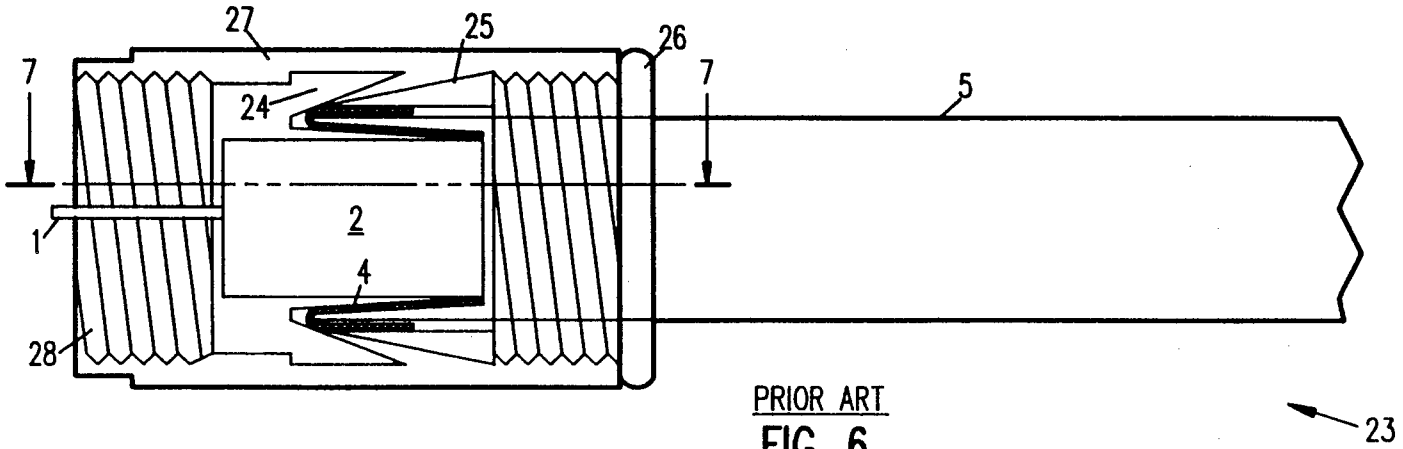
PRIOR ART FIG. 6
FIG. 6 illustrates in partial cross section an EZ F-connector installed on a coaxial cable.
Figure 7:
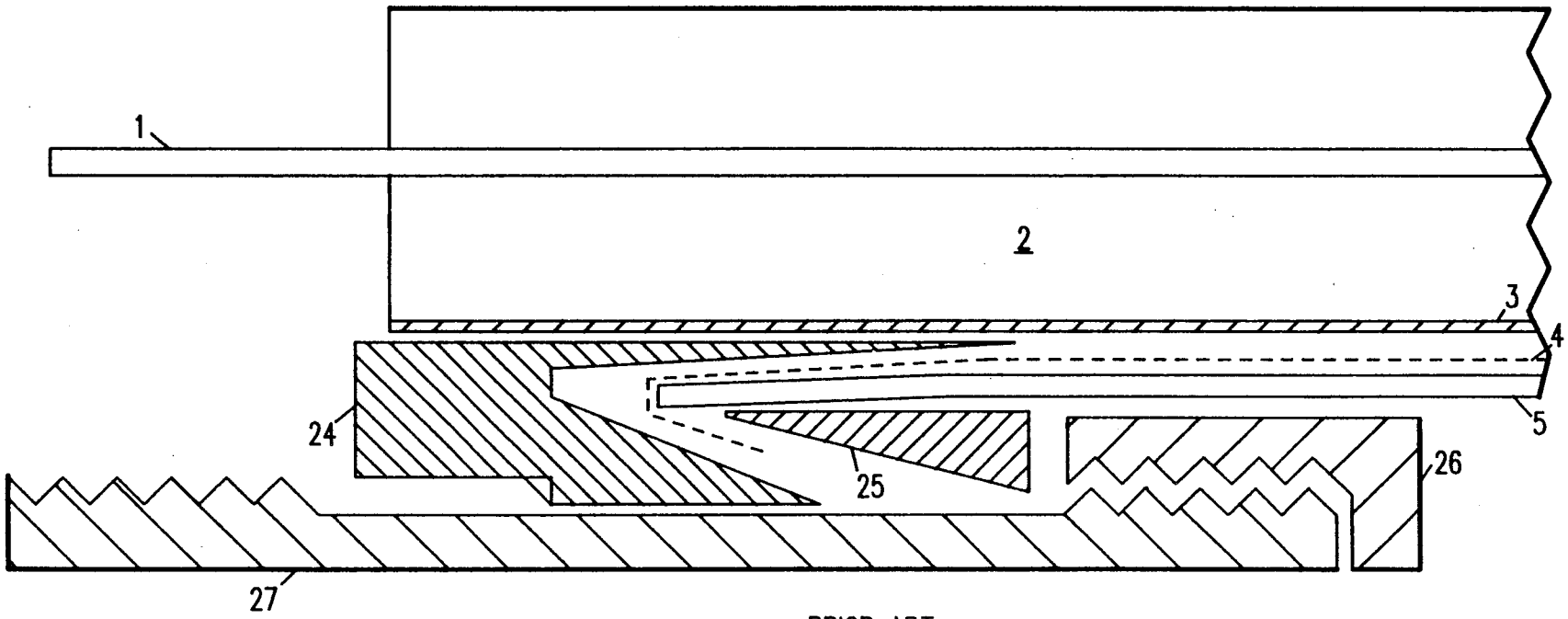
PRIOR ART FIG. 7
FIG. 7 is a highly enlarged, partial sectional view, taken along lines 7—7, of the assembled EZ F-connector and coaxial cable illustrated in FIG. 6.
Figure 8:
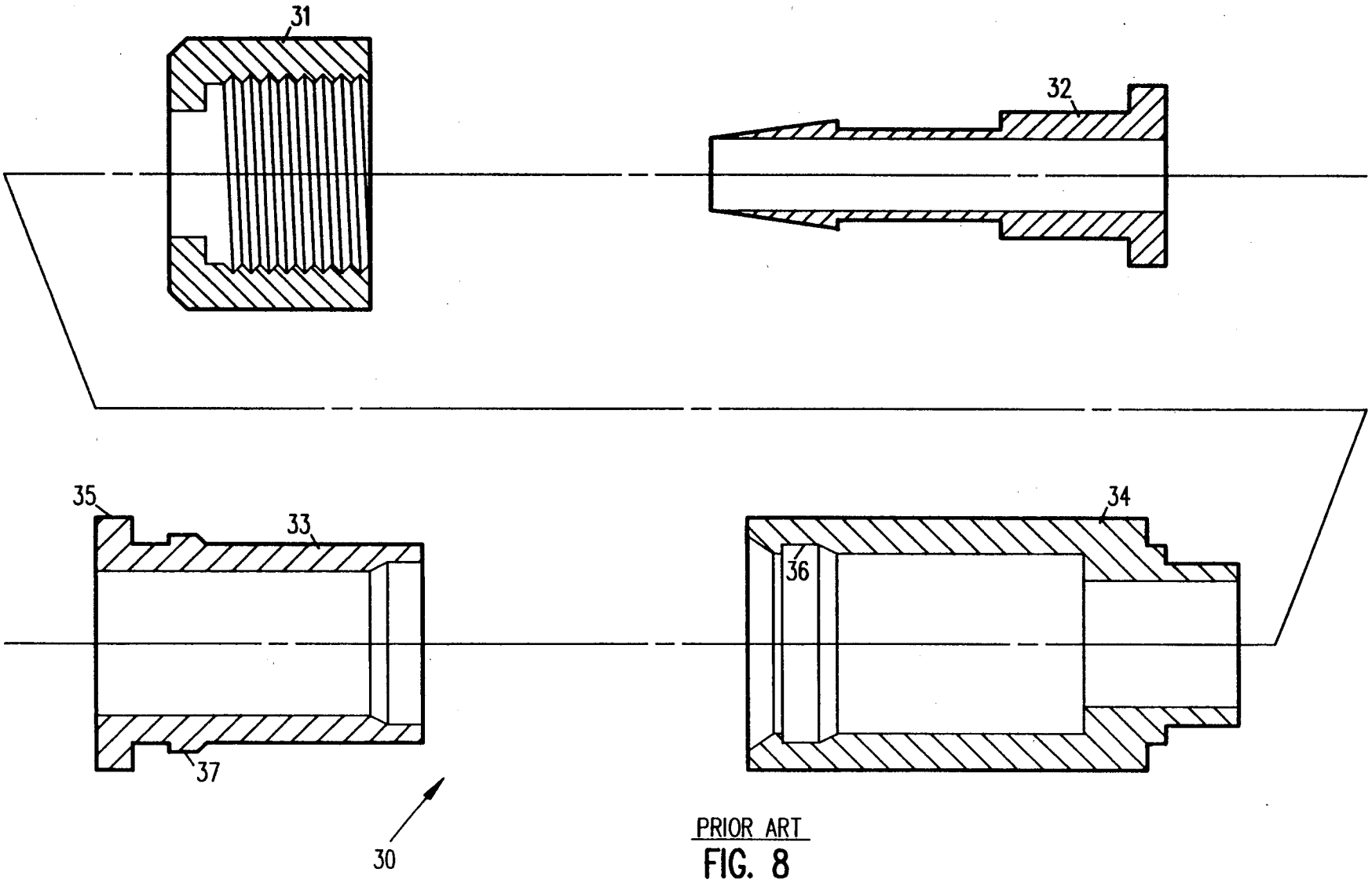
PRIOR ART FIG. 8
FIG. 8 is a typical cross section, exploded view of an Augat LRC SNAP-N-SEAL connector.
Figure 9:
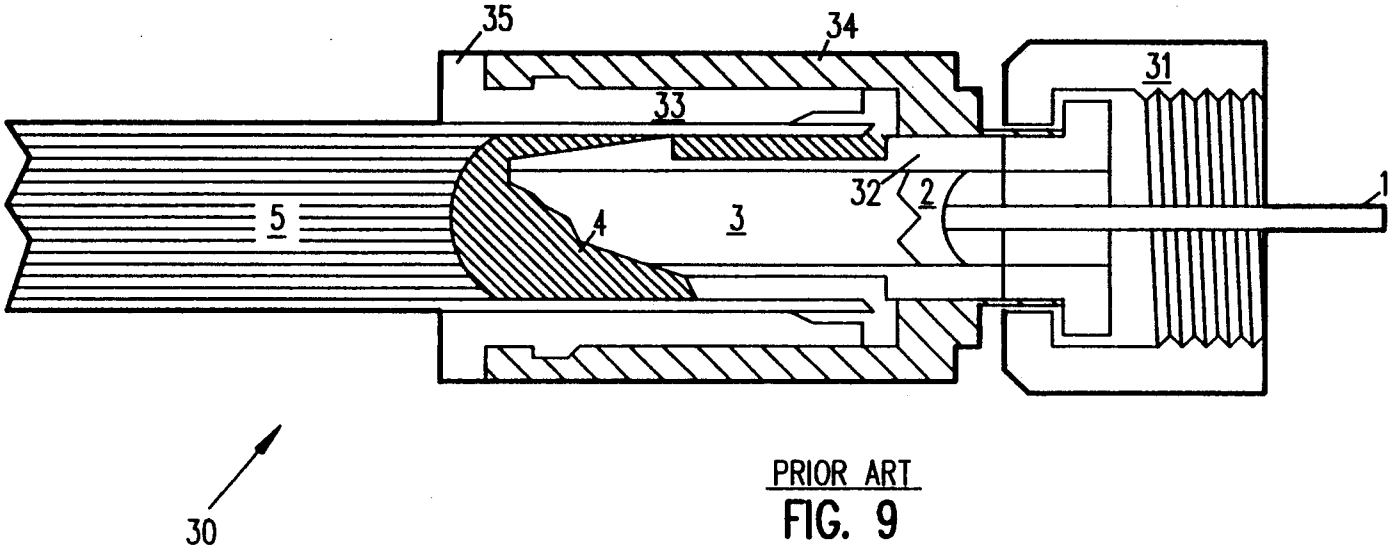
PRIOR ART FIG. 9
FIG. 9 is a cross sectional view of an Augat LRC Snap-N-Seal connector with cable included.
Figure 10A:
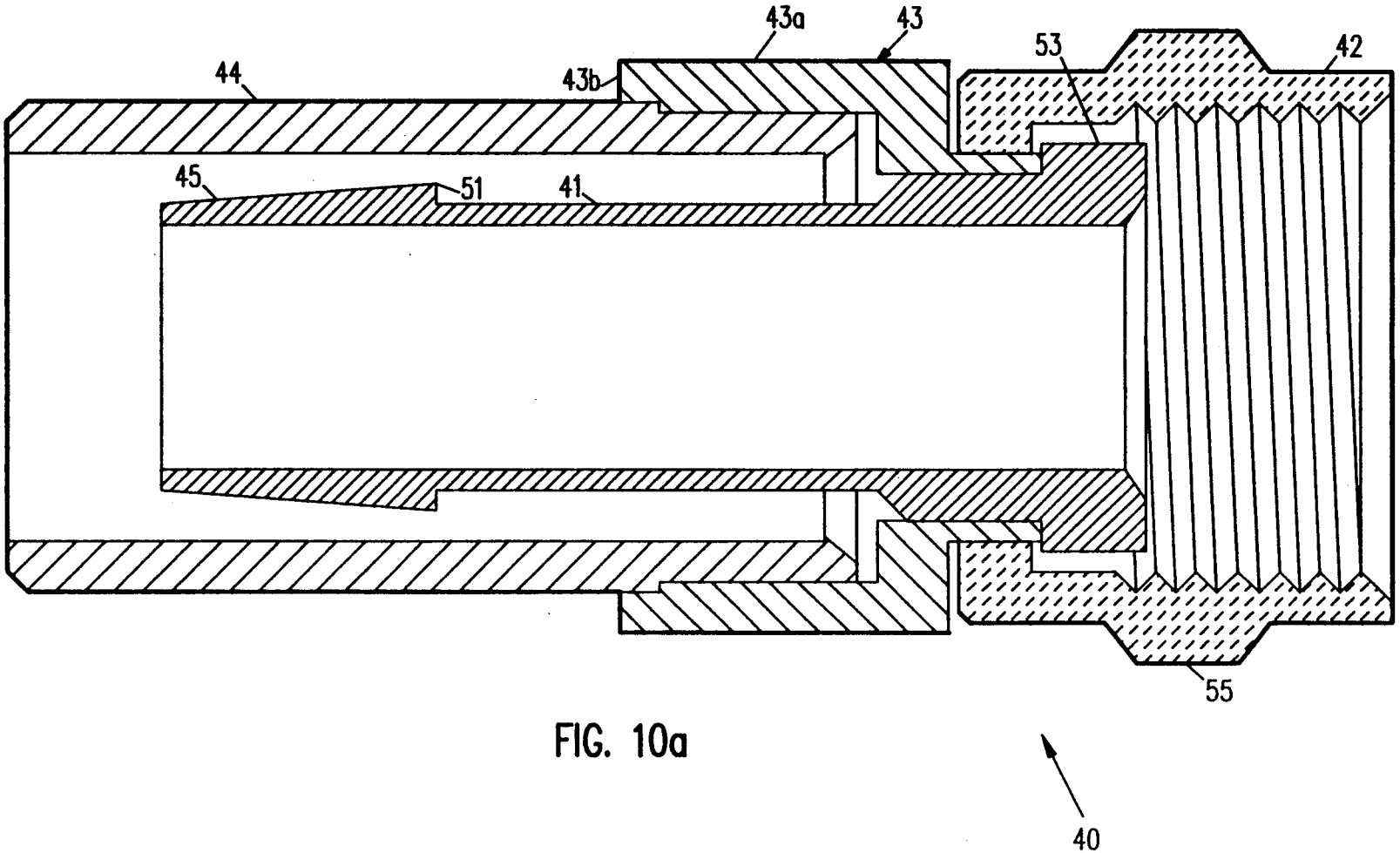
FIG. 10*a* is a cross-sectional view of an assembled connector in accordance with the present invention.
Figure 10B:
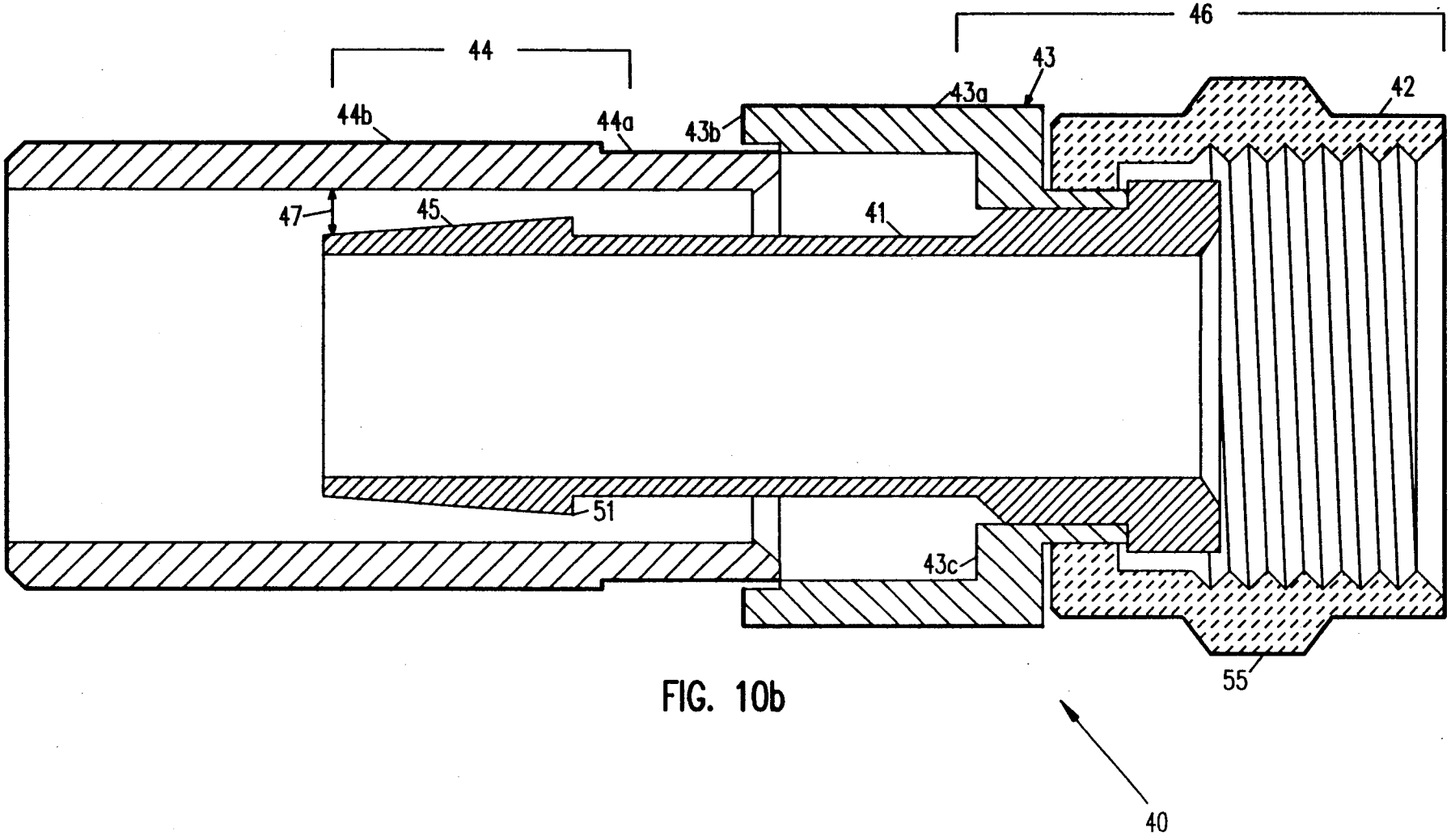
FIG. 10*b* is a cross sectional view of a partially assembled connector in accordance with the present invention.
Figure 11:
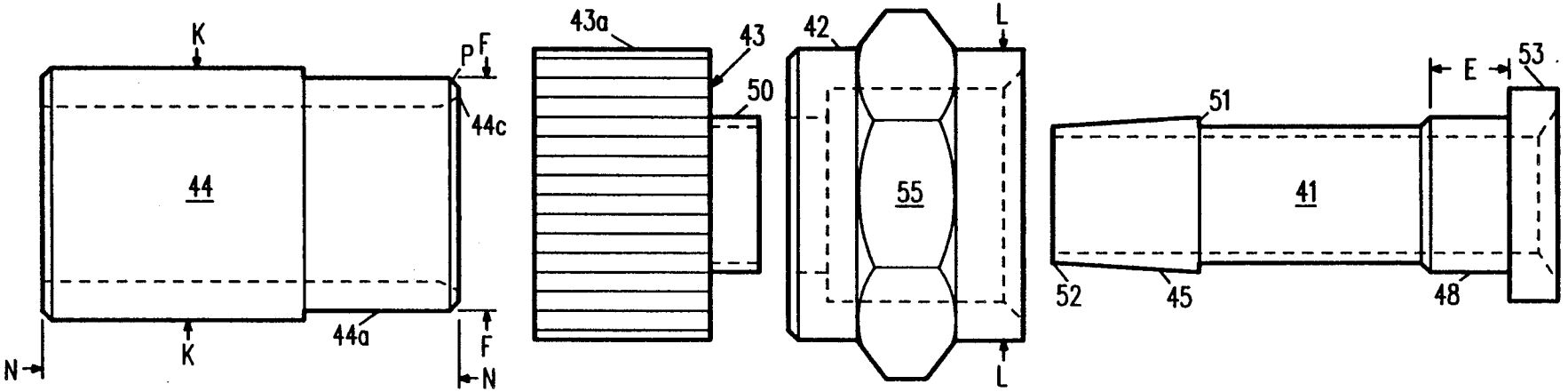
FIG. 11 is an exploded perspective view of each of the parts utilized in the present invention.
Figure 12:
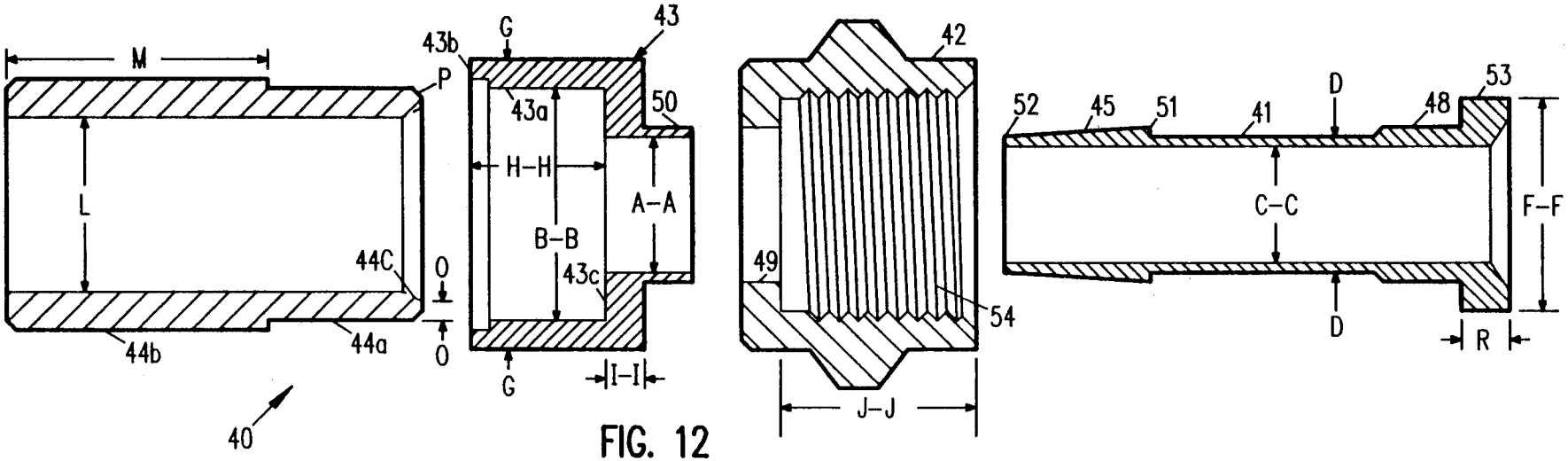
FIG. 12 illustrates in cross section the parts illustrated in FIG. 11.
Figure 13:
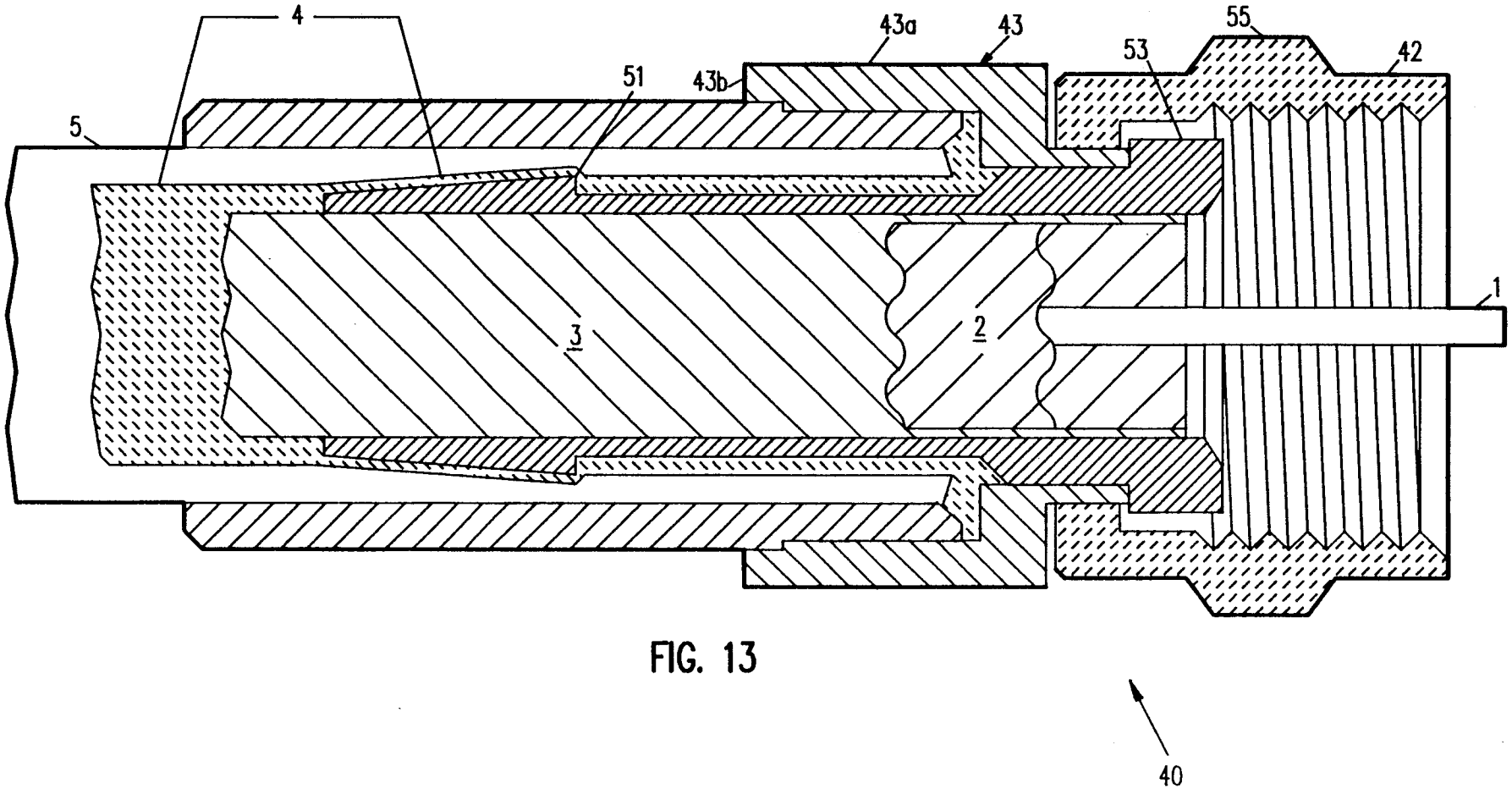
FIG. 13 is a cross sectional view of the connector in accordance with the present invention installed on an end of a coaxial cable.

Connector 40 in accordance with the present invention is illustrated in an assembled state (without a coaxial cable) in FIG. 10*a* and the individual elements of connector 40 are illustrated in an exploded view in FIGS. 11 and 12. FIG. 10*b* illustrates connector 40 partially assembled, not including a coaxial cable. The present invention will be best understood by simultaneous reference to the above referenced figures. Connector 40 is comprised of post 41, nut 42, collar 43 and sleeve 44. It has been found that it is preferable to factory assemble post 41, nut 42 and collar 43 rather than to provide them as separate items for field assembly Sleeve 44 is mated by the user with the preassembled post 41, nut 42 and collar 43 at the time connector 40 is attached to a coaxial cable to form an integral one piece connector completely assembled as illustrated in FIG. 13. To ensure that the addition of sleeve 44 forms an integral one piece unit when assembled with the other elements of connector 40, the external diameter F—F (FIG. 11) of nose portion 44*a* of sleeve 44 is made slightly larger than the inside diameter B—B (FIG. 12) of collar 43. Thus when nose portion 44*a* of sleeve 44 is forcibly pressed into the mating opening of collar 43, the outside surface of nose portion 44*a* rubs against and places the cylindrical skirt portion 43*a* (FIG. 12) of collar 43 under tension thereby ensuring that cylindrical skirt portion 43*a* circumferentially grips and puts in compression the circumferential surface and material of nose portion 44*a* of sleeve 44. By ensuring that under all tolerances the diameter F—F (FIG. 11) is greater than the inside diameter B—B (FIG. 12) of skirt portion 43*a* of collar 43, an integral interference fit is ensured for all connectors. The interference fit results in sleeve 44 forming with collar 43 an integral one piece unit. Preferably, sleeve 44 and collar 43 are of the same material, typically of brass. However, in some instances the brass is plated with a selected material such as tin or cadmium. As will be appreciated by reference to FIGS. 10*a* and 13, in the preferred embodiment free end 43*b* of skirt portion 43*a* of collar 43 terminates at a position between flange 53 and corner 51 of barb 45.

As illustrated in FIG. 10*b*, the post 41 with barb 45 has been assembled with nut 42 and collar 43 into an integral end piece collectively indicated by reference character 46. When sleeve 44 is slid into collar 43 as described above, the annular space 47 between barb 45 and the inner surface of sleeve 44 has pressed against it braid outer conductor 4 associated with the coaxial cable (FIG. 13). The compressive forces applied circumferentially on that braid outer conductor 4 result in firmly holding the connector structure onto the coaxial cable and ensure a good electrical contact between the shielding braid outer conductor 4 and the conductive post 41. This shielding contact ensures, therefore, that connector 40 continues to shield central conductor 1 of the coaxial cable after connector 40 has been formed on the end of the coaxial cable In addition, outside insulation layer 5 also is compressed circumferentially and uniformly around the circumference by the insertion of post 41 into sleeve 44 and the formation of the integral single piece connector from integral end piece 46 and sleeve 44 (illustrated in FIG. 13).

The following dimensions as identified in FIGS. 11–12 are illustrative of the detail of a connector in accordance with the present invention constructed for use with coaxial cable known in the industry as RG 6 standard coaxial cable. However, anyone skilled in the art will understand that the relative sizes of the various pieces can be changed and the same relationship as shown in conjunction with a connector for RG 6 standard cable will hold true.

Integral end piece 46 consists of three pieces: collar 43, nut 42 and post 41 (FIG. 10*b*). These are assembled at the time of manufacturing by pressing collar 43 onto post 41, trapping nut 42 (FIG. 10*b*). The inside dimension A—A (FIG. 12) (0.245 inches) of collar 43 is pressed over shoulder 48 (0.248 inches) on post 41 (FIG. 10*b*). This is a 0.003 inches interference fit which holds integral end piece 46 together. Shoulder 49 on the inside of nut 41 has a width of 0.045 inches which will allow nut 41 to float free on neck 50 (0.60 inches wide) of collar 43. The ID of shoulder 49 of nut 41 inside flange is 0.275 inches (FIG. 12) and the OD of neck 50 of collar 43 is 0.270 inches (FIG. 12). Between these dimensions adequate clearance is provided to allow nut 41 to float and turn freely when being threaded on a mating connector.

The dimensions of the post as pictured in FIGS. 11 and 12, and their functions are as follows The ID (C—C) of the post 41 is 0.196 inches, which provides a space to surround first dielectric 2 of the coaxial cable. The corner 51 of barb 45 has an outside diameter of 0.240 inches which provides a 0.012" lip over the central outside diameter (D—D) of 0.216 inches. The length of the barb 45 from end 52 of post 41 to corner 51 is 0.185 inches. Corner 51 of barb 45 assists in holding the cable connected to integral end piece 46. The length of the central shaft of post 41 from corner 51 to the left hand edge of mating shoulder 48 is 0.317 inches. At the other end of post 41 (opposite from barb 45) mating shoulder 48 and flange 53 are provided Mating shoulder 48 has an outside diameter of 0.248 inches and a length E of 0.103 inches. Flange 53 has an outside diameter F—F of 0.315 inches and a length R of 0.060 inches. The purpose of mating shoulder 48 of the post 41 is to mate with the inside diameter A—A (0.245 inches) of collar 43 thereby holding integral end piece 46 together. This is a 0.003" interference fit.

The outside diameter of the neck 50 of the collar 43 is 0.270. inches. The inside diameter of shoulder 49 (0.275 inches) of nut 41 is placed over the shoulder 50 of collar 43. Shoulder 50 is 0.060 inches wide while shoulder 49 of nut 41 is 0.045 inches wide. This allows nut 41 to turn freely when post 41 is pressed into the collar 43. Other dimensions of the collar 43 include outside diameter G—G of 0.435 inches, inside diameter B—B of 0.360 inches, interior depth H—H of 0.200 inches, and necked down portion I—I of 0.050 inches (FIG. 12).

Other dimensions of nut 42 include interior cavity J—J having a length of 0.255 inches, threaded portion 54 (⅜th inch by 32-thread), outside diameter L—L of 0.430 inches, and hex pattern 55 of 7/16". The overall dimension of post 41 measured from end 52 to the outer edge of flange 53 is 0.680 inches.

The dimension of sleeve 44 (FIGS. 11 and 12) which mates with collar 43 in integral end piece 46 are as follows. The outside diameter K—K is 0.380 inches, inside diameter L is 0.290 inches, main portion **44*b* having a length M of 0.500 inches, nose portion 44*a* of 0.150 inches a total length N—N (FIG. 11) of 0.650 inches, nose piece 44*a* having an OD of 0.365 inches. Internal slanted portion 44*c* is 0.10 inches and 45°, with outer dimension O—O of 0.027 inches at 30°, and slanted portion P of 0.010 inches at 45°. The outside diameter of nose piece 44*a* 0.365 inches of sleeve 44 mates with the inside collar diameter B—B of 0.360 inches thereby creating a 0.005" interference fit once connector 40** is assembled.

As noted above, the foregoing dimensions of the parts of connector 40 are applicable when connector 40 is to be used with standard RG 6 coaxial cable From the above description it will be appreciated that a connector in accordance with the present invention may be advantageously used with other types and sizes of coaxial cables, such as, for example, RG 6 quad shield cable, RG 59 standard cable and RG 59 quad shield cable. The working relationships and functions of the parts of connector 40 remain the same, however various dimensions may require modification. For example, in connector 40 for RG 6 quad shield cable, although the inside diameter and outside diameter of post 41 will remain the same, inside diameter L of sleeve 44 will be greater to accommodate the additional layer of foil and wire braid used in the RG 6 quad shield cable. With RG 59 standard coaxial cable the inside diameter and outside diameter of post 41 will be smaller and the inside diameter L of sleeve 44 will be smaller. For RG 59 quad shield cable the dimensions of post 41 remain the same, however the inside diameter L of sleeve 44 is increased.

Figure 14E:
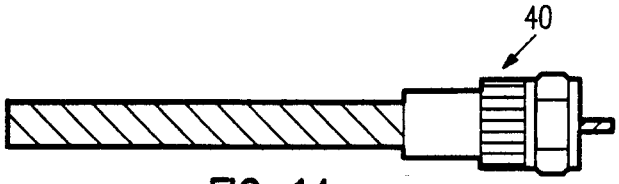
FIGS. 14*a*–14*e* illustrate the steps utilized in assembling a connector in accordance with the present invention on a coaxial cable.
Figure 14D:
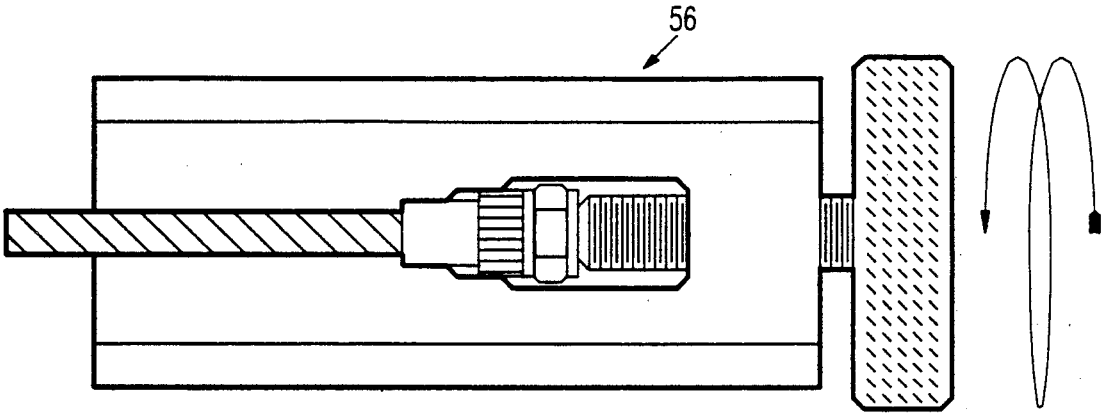
Figure 14C:
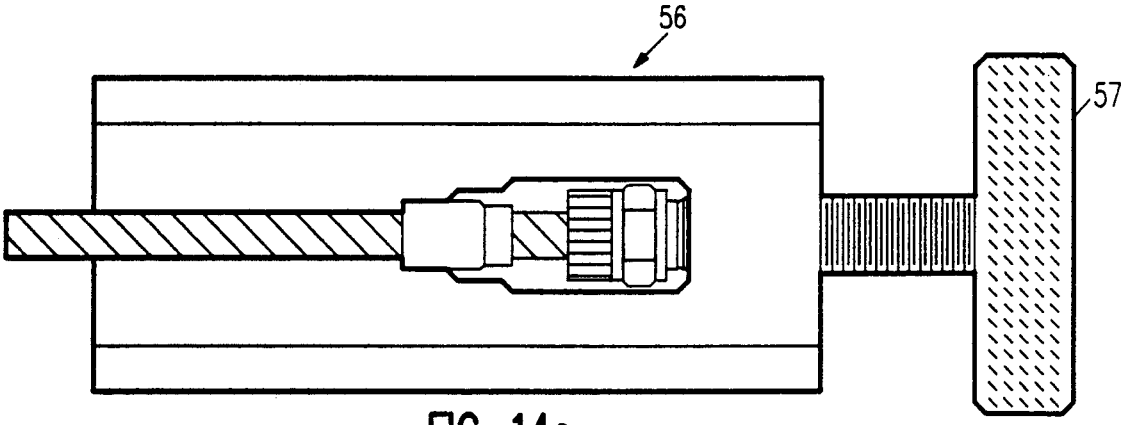
Figure 14B:
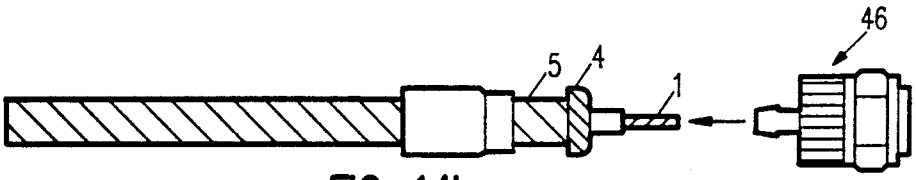
Figure 14A:
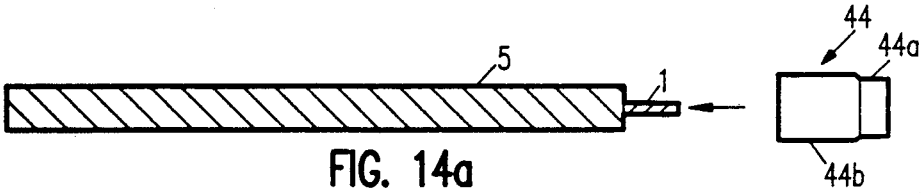

To assemble connector 40 on a coaxial cable, the following steps as pictured in FIGS. **14*a*-14*e* are followed. FIG. 14*a* shows that the portions of the coaxial cable surrounding the central conductor 1 have been stripped back for about ⅜ths of an inch. The sleeve 44 is then slipped over the outside of the cable with main portion 44*b* of the shoulder facing the end of the cable. FIG. 14 shows the outside insulation layer 5 of the coaxial cable stripped back for a distance of 0.20 to 0.25 inches. The underlying wire braid outer conductor 4 is not cut, but rather is is laid back over the outside of the remaining outside insulation layer 5. Integral end piece 46 is then inserted into the coaxial cable with the inside diameter C—C of the post 41 surrounding first dielectric insulator and foil 3, if any, such that post 41 and barb 45 are outside first dielectric insulator 2 and foil 3 covering the first dielectric insulator 2, while the wire braid outer conductor 4 and outside insulation layer 5 are outside of barb 45 on post 41. Integral end piece 46 is inserted into the cable until it cannot be forced any farther down, that is, until inside end 43*c* of collar 43 is contacted by wire braid outer conductor 4 which was bent back over outside insulation layer 5. Sleeve 44 is then brought up as close as possible to integral end piece 46 and the unassembled unit is placed into a tool 56 as shown in FIG. 14*c*. Turning handle 57 of the tool 56 as pictured in FIG. 14*e* forces the integral end piece 46 down on to sleeve 44. FIG. 14*d* shows the tool 56 having fully pressed the integral end piece 46 into sleeve 44. The tool 56 is then removed and the completed structure as pictured in FIG. 14*e* and FIG. 13** in cross section remains.

When integral end piece 46 is mated with sleeve 44 and pressed together, nose piece **44*a* of sleeve 44 is pressed to fit within inside skirt portion 43*a* of collar 43 as illustrated in FIGS. 10*a* and 13. The location of integral end piece 46 and sleeve 44 prior to pressing the integral end piece 46 into sleeve 44 is shown in FIG. 10*b*. Once integral end piece 46 and sleeve 44 are pressed together, they mate as shown in FIG. 10*a*. An interference fit is created between the outside of nose portion 44*a* of sleeve 44 and the inside diameter of skirt portion 43*a* of collar 43 (FIGS. 10*a* and 13**).

The assembled unit with a coaxial cable in place is shown in enlarged cross section in FIG. 13. The coaxial cable as shown in FIG. 13 consists of outside insulation layer 5 which has been stripped back from central conductor 1 and the end of first dielectric 2. Wire braid outer conductor 4 is stripped back from the outside of first dielectric insulator 2 and is folded back over outside insulation layer 5 before the coaxial cable is inserted into integral end piece 46. When post 41 with barb 45 is inserted over first dielectric 2 of the coaxial cable, sharp corner 51 of barb 45 provides additional mechanical resistance to hold the cable in place. Once the sleeve 44 is pressed into integral end piece 46, outside insulation layer 5 and braid outer conductor 4 of the coaxial cable are pressed firmly against the barb 45 of post 41 to prevent the coaxial cable from slipping out of connector 40. Forcing sleeve 44 into collar 43 of integral end piece 46 forces braid outer conductor 4 against inside surface **43*c* of collar 43, providing a good electrical contact. In addition, the presence of the metallic sleeve 44 over the barb 45 of post 41 provides another layer of electromagnetic shielding of central conductor 1** from the outside environment.

Figures 15A, 15B, 15C:
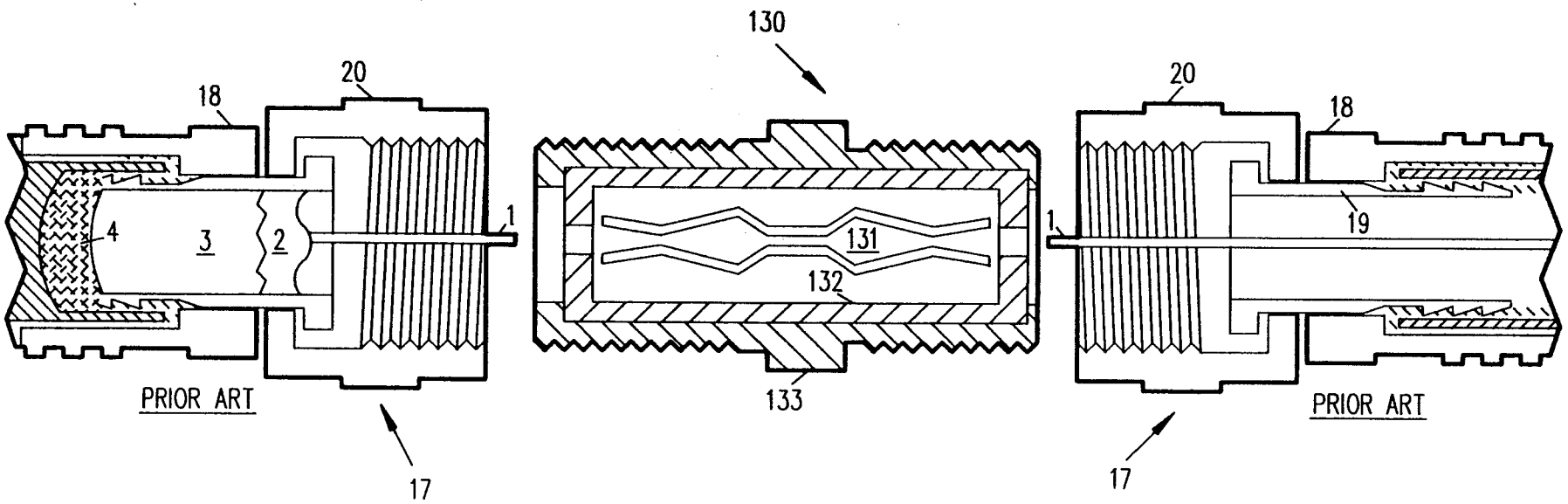
FIG. 15*a* illustrates in cross section the male connector piece which would be provided between the end of two female connectors illustrated in FIGS. 15*b* and 15*c* for a coaxial cable connection.

In order for this connector to be connected to another cable an intermediate coupling 130, FIG. **15*a*, must be provided. Intermediate coupling 130 has a seizing device 131 which is surrounded by dielectric insulator 132, which is surrounded by outer casing 133 threaded at both ends to match threads on nuts 20 of connectors 17 illustrated in FIGS. 15*b* and 15*c*. Once the cables are connected to the coupling as pictured in FIG. 15*a* central conductor 1 of the coaxial cable contacts seizing device 131 of coupling 130 providing electrical contact between central core conductors 1 of each cable. Outside section 133 contacts nut 42 and wire braid outer conductor 4 of the coaxial cable 3**, thereby providing a tightly shielded connection from the one coaxial cable to another.

Other embodiments of the present invention will become obvious to those skilled in the art in light of the above disclosure. It is of course also understood that the scope of the present invention is not to be determined by the foregoing description, but only by the following claims.

We claim:

1. A coaxial cable connector which prior to assembly is two metallic pieces, an end piece having a central axis and an interference portion located on an interior surface of said end piece, wherein said interference portion extends parallel to said central axis for a first predetermined distance, said end piece further including a hollow post located about said central axis of said end piece, and a sleeve having a central axis and a circular bore centered about said central axis of said sleeve, wherein said circular bore is sized to surround an outside covering of a coaxial cable to be engaged with said connector, said sleeve further including an interference portion on an external surface of said sleeve, wherein said interference portion extends parallel to said central axis of said sleeve for a second predetermined distance, and wherein said interference portion of said sleeve is dimensioned such that it fits within said end piece in an interference fit relationship with said interference portion of said end piece, whereby after assembly said end piece and sleeve form a one piece metal unit as a result of direct contact and an interference fit between said interference portion of said end piece and said interference portion of said sleeve and as a result of the mated relationship in which said post is inserted into said coaxial cable, the resulting interaction between said sleeve and said post on said coaxial cable provides a circumferential clamping action on said coaxial cable, clamping said coaxial cable to said connector.

2. A coaxial cable connector as in claim 1, wherein said post includes at least one barb at the end of said post such that when said post is inserted into said cable and said interference portion of said end piece is interference fit with said interference portion of said sleeve, said sleeve causes a portion of said cable to be compressed between said barb on said post and said sleeve when assembled.

3. A coaxial cable connector as in claim 1 where the metal used for one of said two metallic pieces is brass.

4. A coaxial cable connector as in claim 3 where the metal used for one of said two metallic pieces is brass plated with tin.

5. A coaxial cable connector as in claim 3 where the metal used for one of said two metallic pieces is brass plated with silver.

6. A coaxial cable connector as in claim 3 where the metal used for one of said two metallic pieces is brass plated with cadmium.

7. A coaxial cable connector as in claim 3 where the metal used for one of said two metallic pieces is brass plated with nickel.

8. A coaxial cable connector comprising:

a hollow cylindrical post having a first end and a second end, said post having a flange on said first end and a barb located intermediate said first end and said second end;

a nut having a reduced opening on one end coaxial with the body of said nut, said opening having a diameter smaller than the diameter of said flange on said post, said nut positioned on the flange end of said post;

a cylindrical collar having a central axis and a first end supported on said post adjacent to the flange end of said post for retaining said nut on said post, said collar having a skirt portion extending coaxially toward said second end of said post, said skirt portion including an interference portion located on an interior surface of said skirt, wherein said interference portion extends parallel to said central axis for a first predetermined distance; and a cylindrical sleeve having a first end for insertion between the skirt portion of said collar and the exterior of said post, said sleeve having an interference portion on an external surface of said first end of said sleeve, wherein said interference portion extends parallel to the longitudinal axis of said sleeve for a second predetermined distance, and wherein said interference portion of said sleeve is dimensioned such that it fits within said skirt portion of said collar in an interference fit relationship with said interference portion of said skirt;

the inside diameter of said skirt portion, the outside diameter of said first end of said sleeve and thickness of said first end of said sleeve being selected such that when said second end of said post is inserted into a coaxial cable having an outside conductor positioned over the inside insulator of said coaxial cable with said second end of said post positioned between said outside conductor and said inside insulator and said interference portion of said sleeve is in contact with and press fit within said interference portion of said skirt, as a result of the interaction of said post, said collar, and said sleeve after said press fit said sleeve exerts forces on the outside insulator of said coaxial cable and said outside conductor forcing said outside conductor into an intimate contact with said collar and said post.

9. A coaxial cable connector as in claim 8, wherein said post is constructed of brass coated with tin, silver, nickel, cadmium, or any combination thereof.

10. A coaxial cable connector as in claim 8, wherein said nut is constructed of brass coated with tin, silver, nickel, cadmium, or any combination thereof.

11. A coaxial cable connector as in claim 8, wherein said sleeve is constructed of brass coated with tin, silver, nickel, cadmium, or any combination thereof.

12. A coaxial cable connector according to claim 8, wherein said sleeve and said collar are both constructed of brass.

13. A coaxial cable connector according to claim 8, wherein said sleeve and said collar are both plated with tin or cadmium.

14. A coaxial cable connector according to claim 8, wherein the end of said skirt portion terminates at a position intermediate said second end of said post and said flange end of said post.

15. A coaxial cable connector according to claim 14, where the end of said skirt portion terminates at a position intermediate said barb on said post and said flange end of said post.

16. A coaxial cable connector which prior to assembly is two metallic portions, an integral end subassembly having a central axis, said subassembly including an annular skirt portion surrounding and centered about said central axis, said skirt portion having an interference portion with an inside diameter X with said interference portion extending parallel to said central axis of said skirt for a first predetermined distance, said integral end subassembly further including a hollow post located about said central axis of said integral end subassembly, and a sleeve having a central axis and a cylindrical end portion centered about said central axis, said end portion of said sleeve having an interference portion with an outside diameter Y with said interference portion of said sleeve extending parallel to said central axis of said sleeve for a second predetermined distance, wherein $Y \geqq X$, said sleeve being adapted for insertion within said skirt portion such that after assembly said integral end subassembly and said sleeve form a single metal assembly as a result of direct contact and an interference fit between said interference portion of said annular skirt portion and said interference portion of said sleeve, and as a result of the mated relationship in which said post is inserted into said coaxial cable the resulting interaction between said post and said sleeve on said coaxial cable provides a circumferential clamping action on a coaxial cable engaged with said integral end subassembly and positioned within said sleeve to clamp said cable between said end subassembly and said sleeve.

17. A coaxial cable connector as in claim 16, wherein said post includes at least one barb at the end of said post such that when said post is inserted into said cable and said interference portion of said end piece is interference fit with said interference portion of said sleeve, said barb assists the clamping of the cable between said end subassembly and said sleeve when assembled.

18. A coaxial cable connector as in claim 16 where the metal used for one of said two metallic portions is brass.

19. A coaxial cable connector as in claim 18 where the metal used for one of said two metallic portions is brass plated with tin.

20. A coaxial cable connector as in claim 18 where the metal used for one of said two metallic portions is brass plated with silver.

21. A coaxial cable connector as in claim 18 where the metal used for one of said two metallic portions is brass plated with cadmium.

22. A coaxial cable connector as in claim 18 where the metal used for one of said two metallic portions is brass plated with nickel.

23. A coaxial cable connector which prior to assembly is two metallic pieces, an end piece having a central axis with a skirt portion with an inside surface parallel to said first central axis for a first predetermined distance, said end piece further including a hollow post located about said central axis of said end piece, and a sleeve having a central axis and an end portion with an outside surface parallel to said central axis of said sleeve for a second predetermined distance, said end portion adapted to form an interference fit with said skirt portion when assembled, said end piece and said sleeve after assembly forming a one piece metal unit as a result of an interference fit between said end piece and said sleeve, and wherein as a result of the mated relationship between said end piece and said sleeve in which said post is inserted into said coaxial cable the resulting interaction between said post and said sleeve on said coaxial provides a circumferential clamping action on a coaxial cable engaged with said end piece to clamp said coaxial cable to said connector;

wherein said connector is produced by the steps of:

placing said skirt portion of said end piece adjacent to said end portion of said sleeve such that said central axis of said end piece is approximately collinear with said central axis of said sleeve;

engaging said end piece and said sleeve with a pressing device;

pressing said skirt portion of said end piece together with said end portion of said sleeve to form said interference fit between said skirt portion of said end piece and said end portion of said sleeve; and disengaging said pressing device from said end piece and said sleeve.

24. A coaxial cable connector according to claim 23, wherein said skirt portion of said end piece includes a shoulder and said end portion of said sleeve includes a shoulder and said pressing step presses said skirt portion of said end piece together with said end portion of said sleeve until said shoulder of said sleeve is contacted by said shoulder of said end piece.

25. A coaxial cable connector which prior to assembly is two metallic portions, an integral end subassembly having a central axis, said subassembly including an annular skirt portion surrounding and centered about said central axis, said skirt portion having an inside diameter X with said skirt portion extending parallel to said central axis of said end subassembly for a first predetermined distance, said integral end subassembly further including a hollow post located about said central axis of said integral end subassembly, and a sleeve having a central axis and a cylindrical end portion centered about said central axis, said end portion of sleeve having an outside diameter Y with said end portion extending parallel to said central axis of said sleeve for a second predetermined distance, wherein $Y \geqq X$, said sleeve being adapted for insertion within said skirt portion such that after assembly said integral end subassembly and said sleeve form a single metal assembly as a result of direct contact and an interference fit between said annular skirt portion and said end portion, and where as a result of the mated relationship in which said post is inserted into said coaxial cable the resulting interaction between said post and said sleeve on said coaxial cable provides a circumferential clamping action on a coaxial cable engaged with said integral end subassembly and positioned within said sleeve clamps said cable between said end subassembly and said sleeve;

wherein said connector is produced by the steps of:

placing said annular skirt portion of said end piece adjacent to said cylindrical end portion of said sleeve such that said central axis of said end subassembly is approximately collinear with said central axis of said sleeve;

engaging said end subassembly and said sleeve with a pressing device;

pressing said annular skirt portion of said end piece together with said cylindrical end portion of said sleeve to form said interference fit between said annular skirt portion of said end piece and said cylindrical end portion of said sleeve; and disengaging said pressing device from said end subassembly and said sleeve.

* * * * *

UNITED STATES PATENT AND TRADEMARK OFFICE

CERTIFICATE OF CORRECTION

PATENT NO. : 5,002,503

DATED : March 26, 1991

INVENTOR(S) : George T. Campbell

It is certified that error appears in the above-identified patent and that said Letters Patent is hereby corrected as shown below:

Column 1, line 34, "conductor 3", should read --conductor 4--.

Column 2, line 16, after "channels" insert --7--.

Column 4, line 40, after "assembly" insert --.--.

Column 5, line 25, after "bly" insert --.--.

Column 6, lines 28-29, " "cold plastic flow" " should read --"plastic cold flow"--.

Column 6, line 42, delete the first occurance of "the".

Column 7, line 43, after "assembly" insert --.--.

Column 8, line 20, after "cable" insert --.--.

Column 8, line 44, delete "0.60" and insert --0.060--.

Column 9, line 25, after "inches" insert --,--.

Column 9, line 27, delete "0.10" and insert --0.010--.

Column 9, line 31, after "inches" insert --,--.

UNITED STATES PATENT AND TRADEMARK OFFICE

CERTIFICATE OF CORRECTION

PATENT NO. : 5,002,503

DATED : March 26, 1991

INVENTOR(S) : Geroge T. Campbell

It is certified that error appears in the above-identified patent and that said Letters Patent is hereby corrected as shown below:

Column 9, line 65, delete first occurrence of "is".

Signed and Sealed this

Third Day of November, 1992

*Attest:*

DOUGLAS B. COMER

*Attesting Officer*

*Acting Commissioner of Patents and Trademarks*